US006689045B2

(12) United States Patent
Kennedy et al.

(10) Patent No.: US 6,689,045 B2
(45) Date of Patent: Feb. 10, 2004

(54) METHOD AND APPARATUS FOR IMPROVING SIGNAL QUALITY IN IMPLANTABLE HEARING SYSTEMS

(75) Inventors: Joel A. Kennedy, Arden Hills, MN (US); Kai Kroll, Minneapolis, MN (US)

(73) Assignee: St. Croix Medical, Inc., Minneapolis, MN (US)

( * ) Notice: Subject to any disclaimer, the term of this patent is extended or adjusted under 35 U.S.C. 154(b) by 231 days.

(21) Appl. No.: 10/015,735

(22) Filed: Dec. 12, 2001

(65) Prior Publication Data

US 2002/0123662 A1 Sep. 5, 2002

Related U.S. Application Data

(63) Continuation of application No. 09/159,915, filed on Sep. 24, 1998, now Pat. No. 6,364,825.

(51) Int. Cl.[7] ..... H04R 25/00
(52) U.S. Cl. ..... 600/25
(58) Field of Search ..... 600/25; 181/129–130, 181/132–137; 381/312–331

(56) References Cited

U.S. PATENT DOCUMENTS 3,346,704 A 10/1967 Mahoney
3,557,775 A 1/1971 Mahoney (List continued on next page.)

(List continued on next page.)

FOREIGN PATENT DOCUMENTS

DE P2 203 1949 7/1994
DE 196 18 961 A1 11/1997
DE 196 38 158 A1 4/1998
DE 196 38 159 A1 4/1998
EP 0 263 254 A1 4/1998
WO WO 98/06235 2/1998

OTHER PUBLICATIONS

US 5,730,699, 3/1998, Adams et al. (withdrawn)
Berlincourt, D., "Piezoelectric Ceramics: Characteristics and Applications," Journal of the Acoustical Society of America, 70(6): 1586–1595, (1981).
Cook, R.O., et al., "Comparison of Acoustically Coupled and Mechanically Coupled Speech," Audiology, 20: 516–529 (1981).
Dumon, M.D., T. et al., "Piezoelectric Middle Ear Implant Preserving the Ossicular Chain," Otolaryngologic Clinics of North America, 28:173–188, (1995).

(List continued on next page.)

*Primary Examiner*—John P. Lacyk
(74) *Attorney, Agent, or Firm*—Fredrikson & Byron, P.A.

(57) ABSTRACT

An implantable hearing assistance system includes a sensor transducer and an electronics unit. The sensor transducer, such as a piezoelectric transducer, is operatively coupled to an auditory element of the middle ear (e.g., malleus), and electrically connected to the electronics unit. The transducer and the electronics unit are arranged together to minimize the driving impedance and lead capacitance therebetween, thereby minimizing susceptibility to electromagnetic interference and minimizing high audio frequency signal attenuation.

In one example, the transducer and the electronics unit are disposed immediately adjacent each other or physically joined together to virtually eliminate (or at least significantly shorten) the length of the electrical connection between the transducer and the electronics unit. In another example, the electronics unit is located remotely from the transducer, and a preamplifier (or other impedance transforming electronics) is placed in close physical proximity to the transducer in the middle ear between the transducer and the remaining electronics unit.

83 Claims, 2 Drawing Sheets

U.S. PATENT DOCUMENTS

| | | | |
|---|---|---|---|
| 3,594,514 | A | 7/1971 | Wingrove |
| 3,712,962 | A | 1/1973 | Epley |
| 3,764,748 | A | 10/1973 | Branch et al. |
| 3,870,832 | A | 3/1975 | Fredrickson |
| 3,882,285 | A | 5/1975 | Nunley et al. |
| 3,940,974 | A | 3/1976 | Taylor |
| 3,947,647 | A | 3/1976 | Swinehart |
| 3,970,862 | A | 7/1976 | Edelman et al. |
| 4,052,754 | A | 10/1977 | Homsy |
| 4,063,048 | A | 12/1977 | Kissiah, Jr. |
| 4,204,135 | A | 5/1980 | Murayama |
| 4,207,441 | A | 6/1980 | Ricard et al. |
| 4,284,856 | A | 8/1981 | Hochmair et al. |
| 4,357,497 | A | 11/1982 | Hochmair et al. |
| 4,369,391 | A | 1/1983 | Micheron |
| 4,441,210 | A | 4/1984 | Hochmair et al. |
| 4,520,236 | A | 5/1985 | Gauthier |
| 4,601,723 | A | 7/1986 | McGrew |
| 4,606,329 | A | 8/1986 | Hough |
| 4,628,907 | A | 12/1986 | Epley |
| 4,696,287 | A | 9/1987 | Hartmann et al. |
| 4,729,366 | A | 3/1988 | Schaefer |
| 4,774,933 | A | 10/1988 | Hough et al. |
| 4,776,322 | A | 10/1988 | Hough et al. |
| 4,800,884 | A | 1/1989 | Heide et al. |
| 4,817,607 | A | 4/1989 | Tatge |
| 4,850,962 | A | 7/1989 | Schaefer |
| 4,918,745 | A | 4/1990 | Hutchison |
| 4,957,478 | A | 9/1990 | Maniglia |
| 4,988,333 | A | 1/1991 | Engebretson et al. |
| 5,012,520 | A | 4/1991 | Steeger |
| 5,015,224 | A | 5/1991 | Maniglia |
| 5,015,225 | A | 5/1991 | Hough et al. |
| 5,030,198 | A | 7/1991 | Anderson |
| 5,061,282 | A | 10/1991 | Jacobs |
| 5,083,312 | A | 1/1992 | Newton et al. |
| 5,084,699 | A | 1/1992 | DeMichele |
| 5,085,628 | A | 2/1992 | Engebretson et al. |
| 5,259,033 | A | 11/1993 | Goodings et al. |
| 5,277,694 | A | 1/1994 | Leyaieffer et al. |
| 5,279,292 | A | 1/1994 | Baumann et al. |
| 5,282,858 | A | 2/1994 | Bisch et al. |
| 5,318,502 | A | 6/1994 | Gilman |
| 5,344,422 | A | 9/1994 | Frigg |
| 5,411,467 | A | 5/1995 | Hortman et al. |
| 5,456,654 | A | 10/1995 | Ball |
| 5,498,226 | A | 3/1996 | Lenkauskas |
| 5,531,787 | A | 7/1996 | Lesinski et al. |
| 5,554,096 | A | 9/1996 | Ball |
| 5,558,618 | A | 9/1996 | Maniglia |
| 5,624,376 | A | 4/1997 | Ball et al. |
| 5,707,338 | A | 1/1998 | Adams et al. |
| 5,762,583 | A | 6/1998 | Adams et al. |
| 5,788,711 | A | 8/1998 | Lehner et al. |
| 5,800,366 | A | 9/1998 | Ball et al. |
| 5,879,283 | A | 3/1999 | Adams et al. |
| 5,897,283 | A | 4/1999 | Lenguyen |
| 5,897,486 | A | 4/1999 | Ball et al. |
| 5,899,847 | A | 5/1999 | Adams et al. |
| 5,913,815 | A | 6/1999 | Ball et al. |
| 5,935,166 | A | 8/1999 | Kennedy |
| 5,954,628 | A | 9/1999 | Kennedy |
| 5,960,093 | A | 9/1999 | Miller |
| 5,993,376 | A | 11/1999 | Kennedy |
| 5,997,466 | A | 12/1999 | Adams et al. |
| 6,005,955 | A | 12/1999 | Kroll |
| 6,041,131 | A | 3/2000 | Kirchhoefer et al. |
| 6,093,144 | A | 7/2000 | Jaeger et al. |
| 6,113,531 | A | 9/2000 | Leysieffer |
| 6,140,740 | A | 10/2000 | Porat et al. |
| 6,162,169 | A | 12/2000 | Leysieffer |
| 6,190,305 | B1 | 2/2001 | Ball et al. |
| 6,190,306 | B1 | 2/2001 | Kennedy |
| 6,208,743 | B1 | 3/2001 | Marten et al. |

OTHER PUBLICATIONS

Gyo, K., et al., "Sound Pickup Utilizing an Implantable Piezoelectric Ceramic Bimorph Element: Application to the Cochlear Implant," American Journal of Otology, 5:273–276, (1984).

Hough, M.D., J., et al., "Middle Ear Implantable Hearing Device: Ongoing Animal and Human Evaluation," Ann. Otol. Rhinol Laryngol, 97:650–658, (1988).

Kartush, M.D., J.M., "Electromagnetic Ossicular Augmentation Device," Otolaryngologic Clinics of North America, 28:155–172, (1995).

Gyo, K., et al., "Stapes Vibration Produced by the Output Transducer of an Implantable Hearing Aid," Archives of Otolaryngology Head and Neck Surgery, 113:1078–1081, (1987).

Gyo, K., et al., "Measurement of Stapes Vibration Driven by the Ceramic Vibrator of a Middle Ear Impalnt—Human Temporal Bone Experiments," Advances in Audiology (Karger, Basil), 4:107–116, (1988).

Kodera, K., et al., "Evaluation of the Ceramic Vibrator in the Cat," Advances in Audiology (Karger, Basel), 4:97–106, (1988).

Ko, PhD., W., "Engineering Principles of Mechanical Stimulation of the Middle Ear," Otolaryngologic Clinics of North America, 28:19–41 (1995).

Maniglia, M.D., A.J., et al., Contactless Semi–Implantable Electromagnetic Middle Ear Device for the Treatment of Sensorineural Hearing Loss: Short–Term and Long_Term Animal Experiments,: Otolaryngologic Clinics of North America, 28: 121–140, (1995).

Maniglia, M.D., A.J., "Implantable Hearing Devices: State of the Art," Otolaryngologic Clinics of North America, 28:175–200, (1989).

Ohno, T., et al., "Structure and Performance of the Main Components," Advances in Audiology (Karger, Basel), 4:52–72, (1988).

Ohno, T., "The Implantable Hearing Aid," Audecibel, Fall 1984, Winter 1985, (1984).

Stach, PhD., B.A., et al., "Hearing Aids: I. Conventional Hearing Devices," Archives of Otolaryngology Head and Neck Surgery, 122:227–231, (1996).

Suzuki, M.D., J.I., et al., "Partially Implantable Piezoelectric Middle Ear Hearing Device: Long–Term Results," Otolaryngologic Clinics of North America, 28:99–106, (1995).

Suzuki, M.D., J.I., "Principle, Copnstruction and Indication of the Middle Ear Implant," Advances in Audiology, 4:15–21, (1988).

Suzuki, J.I., et al., "Middle Ear Implant–Implantable Hearing Aid," Advances in Audiology (Karger) 77–80, (Nov. 1983).

Wilpizeski, PhD., C., et al., "A Simple Implantable Elecgtromechanical Middle Ear," Transactions of the Pennsylvania Academy of Ophthalmology and Otolaryngology, 32:41–46, (1979).

Yanagihara, M.D., N., et al., "Partially Implantable Hearing Aid Using Piezoelectric Ceramic Ossicular Vibrator," Otolaryngologic Clinics of North America, 28:85–98, (1995).

Yanagihara, N., et al., "Efficacy of the Partially Implantable Middle Ear Implant in Middle and Inner Ear Disorders," Advances in Audioilogy, 4:149–159, (1988).

Riggs, M. T., "Powered Incus Replacement Prosthesis (SBIR Grant Application),," Letter, (1983).

Maniglia, M.D., A.J., "A Contactless Electromagnetic Implantable Middle Ear Device for Sensorineural Hearing Loss," Ear, Nose and Throat Journal, 73(2), (1994).

Hough, M.D., J., "A Middle Ear Implantable Hearing Device for Controlled Amplification of Sound in the Human: A Preliminary Report," Laryngoscope, 97:141–151, (1987).

Lenkauskas, E., "Totally Implantable Hearing Aid Device," Transplants and Implants in Otology II, 371–375, (1991).

Borg, E., et al., The Middle–Ear Muscles:, Scientific American (Aug. 1989).

Dormer, PhD., K.J., et al., "Selection of Biomaterials for Middle and Inner Ear Implants", Otolaryngologic Clinics of North America, 28:17–28, (1995).

Glorig, A., et al, Magnetically Coupled Stimulation of the Ossicular Chain: Measures in Kangaroo Rat and Man:, Journal if the Acoustical Society of America, 52: 694–696, (1972).

Goode, M.D., R.L., "Current Status of Electromagnetic Implantable Hearing Aids", Otolaryngologic Clinics of North America, 28:201–209, (1989).

Goode, M.D.., R.L., "Electromagnetic Implantable Hearing Aids", Advances in Audiology (Karger, Basel), 4:22–31, (1988).

Goode, M.D., R.L., "Implantable Hearing Aids", Otolaryngologic Clinics of North America, 11:155–161, (1978).

Goode, M.D., R.L., et al., "Audition Via Electromagnetic Induction", Archives of Otolaryngology, 98:23–26. (1973).

Goode, M.D., R.L., "An Implantable Hearing Aid", Tr. Am. Academy of Ophth, and Otol., 74:128–139, (1970).

Gyo, K., et al. Measurement of the Ossicular Vibration Ratio in Human Temporal Bones by Use of A video Measuring System:, Acta Otolaryngol, 103:87–95, (1987).

Gyo, K, et al., "Effect of Middle Ear Modification on Umbo Vibration":, Archives of Otolaryngology Heard and Neck Surgery, 112:1262–1268, (1986).

Kodera, M.D., K., et al, "Sound Evaluation of Partially Implantable Piezoelectric Middle Ear Implant: Comparative Study of Frequency Responses", Ear, Nosed and Throat Journal, 73:108–111, (1994).

Maniglia, M.D, A.J., et al., "Electromagnetic Implantable Middle Ear Hearing Device of the Ossicular–Stimulating Type: Principles, Designs, and Experiments", Ann. Otol. Rhinol Larygol, 97 (suppl 136), part 2, (1988).

Ohno, T., et al., "Performance of the Middle Ear Implants," Advances in Audiology (Karger, Basel), 4:85–96 (1988).

Spindel, PhD., J.H. et al., "The Round Window Electromagnetic Implantable Hearing Aid Approach", Otolaryngologic Clinics of North America, 28: 189–206, (1995), Suzuki, M.D., J.I., et al., "Further Clinical Experiences with Middle–Ear Implantable Hearing Aids: Indications and Sound Quality Evaluation", ORL, 51:229–234, (1989).

Suzuki, J.I., et al, "Implantation of Partially Implantable Middle Ear Implant and the Indication", Advances in Audiology (Karger, Basel), 4:160–166, (1988).

Suzuki, J.I. et al., "Early Studies and the History of Development of the Middle Ear Implant in Japan", Advances in Audiology (Karger, Basel), 4:1–14, (1988).

Suzuki, J. et al., Middle Ear Implant for Humans, Acta Otolaryngol, 99:313–317, (1985).

Velmans, PhD., M.L., "New Ears for Old: Auditory Implants and Frequency Transposing Hearing Aids", Journal of Royal College Physicians, London, 16:83–88, (1982).

Yanagihara, N. et al., "Intraoperative Assessment of Vibrator–Induced Hearing", Advances in Audiology, 4:124–133, (1988).

Yanagihara, N. et al., "Implantable Hearing Aid", Archives of Otolaryngology Heard and Neck Surgery, 113: 869–872, (1987).

Yanagihara, M.D. et al, "Development of an Implantable Hearing Aid Using a Piezoelectric Vibrator of Bimorph Design: State of the Art", Otolaryngology Head and Neck Surgery 92:706–712, (1984).

Yanagihara, M.D., N. et al., Perception of Sound Through Direct Oscillation of the Stapes Using a Piezoelectric Ceramic Bimorph, Ann. Otol. Rhinol. Laryngol, 92:223–227, (1983).

Spindel, PhD., J.H., "Current Status of Implantable Hearing Aids", University of Virginia, journal unknown, (1995).

Gyo, M.D., K., et al., "Present Status and Outlook of the Implantable Hearing Aid", American Journal of Otology, 11:250–253, (1990).

Goode, M.D., R.L., "Current Status and Future of Implantable Electromagnetic Hearing Aids", Otolaryngologic Clinics of North America, 28:141–146, (1995).

Goode, R.L., "Implantable Hearing Devices", Medical Clinics of North America, 75:1261–1266, (1991).

Maniglia, A.J. et al., "Design, Development, and Analysis of a Newer Electromagnetic Semi–Implantable Middle Ear Hearing Device", Transplants and Implants in Otology II, 371–375, (1991).

Maniglia, A.J et al., "Contactless, Semi–Implantable Electromagnetic Hearing Device for the Treatment of Sensorineural Hearing Loss", Abstract of Paper Presented at International Symposium on Electronic Implants in Otology and Conventional Hearing Aids. Walt Disney World Swan, Abstract #29, (Nov. 11–14, 1993).

Suzuki, J.I. et al., "Long–Term Clinical Results of the Partially Implantable Piezoelectric Middle Ear Implatn", Ear, Nose and Throat Journal, 73(2): 104–107. (Feb. 1994).

Tos, M. et al., "Implantation of Electromagnetic Ossicular Replacement Device", Ear, Nose and Throat Journal, 73(2): 93–103, (Feb. 1994).

Yanagihara, M.D., N. et al., "Partially Implantable Hearing Aid Using Piezoelecric Ceramic Ossicular Vibrator", Abstract of Paper Presented at International Symposium on Electronic Implants in Otology and Conventional Hearing Aids. Walt Disney World Swan, Abstract #26, (Nov. 11–14, 1993).

Bento, M.D., R. et al., "A Pathway for Information Transmission to the Ear", ENT–Ear, Nose & Throat Journal, 74(9): 640–644, (Sep. 1995).

Hunyadi, Jr., S., et al., "Effect of Magnetic Resonance Imaging on a New Electromagnetic Implantable Middle Ear Hearing Device", The American Journal of Otology, vol. 18, No. 3 (1997).

Maniglia, MD, A. et al., "A Contactless Electromagnetic Implantable Middle Ear Device for Sensorineural Hearing Loss", ENT Journal, vol. 73, No. 2 (Feb. 1994).

St. Croix Medical, "Envoy Electronic–Piezokinetic Ossicular Replacement Prostheses (E–PORP) System", stcroix-medical.com/prod01.htm (1998).

METHOD AND APPARATUS FOR IMPROVING SIGNAL QUALITY IN IMPLANTABLE HEARING SYSTEMS

This application is a continuation of application Ser. No. 09/159,915, filed on Sep. 29, 1998, now U.S. Pat. No. 6,264,825.

BACKGROUND OF THE INVENTION

1. Field of the Invention

The present invention relates to implantable hearing systems for assisting hearing in hearing-impaired persons. In particular, the present invention relates to improving signal quality in implantable hearing assistance systems by reducing electromagnetic interference and minimizing high frequency audio signal attenuation.

2. Description of Related Art

Some implantable hearing assistance systems use a microphone located in or near the ear to convert acoustic sound energy into an electrical signal. The electric signal is amplified, modulated and then directly communicated by a transducer to the inner ear to stimulate the cochlea to assist hearing. Alternatively, the amplified signal is communicated to a transducer for conversion to mechanical acoustic energy for vibratory application to the stapes of the middle ear or the cochlea. The microphone can be located externally, adjacent the ear, or within the external auditory canal. The transducer is commonly connected to a portion of the middle ear, known as the ossicular chain, which includes the malleus, incus and stapes. Vibrations are emitted from the transducer into and through the ossicular chain to the cochlea of the inner ear.

Electrical connections such as lead wires are used to span the gaps between the transducer and the electronics unit/amplifier. For example, FIG. 1 illustrates a prior art conventional hearing assistance system with such lead wires. System 10 is implanted into auditory system 11 and includes a sensor transducer 12, lead wires 14, and electronics amplifier unit 16 and driver transducer 18. Transducer 12 is located within the middle ear and operatively coupled to malleus 20 of the middle ear. Lead wires 14 extend from sensor 12 to electronics/amplifier 16 and then to driver transducer 18, which is operatively coupled to stapes 22.

When the length of the electrical lead wires 14 becomes significant, system 10 is increasingly susceptible to electromagnetic interference (EMI). EMI is the reception of unwanted electrical signals that are present in the environment at all times. Most EMI is caused by signals at very high frequencies, such as those used in cellular phones (e.g., 900 MHz). Under some conditions these high-frequency signals can cause low-frequency, audible, interference in electronic sound processing devices. A device's susceptibility to EMI is related to the input impedance of the conductor receiving the EMI and to the physical size of that conductor. A large conductor with a high-input impedance will be more susceptible to EMI.

An additional problem encountered when using a high-impedance sensor is the effect of the lead capacitance which it must drive. A larger capacitance will cause high frequency audio signals to be attenuated. For example, a longer lead wire driven by a high-impedance sensor yields a large capacitance, producing high frequency audio signal attenuation.

Since very small changes in signals and acoustics mean large changes in the quality of hearing, even small amounts of EMI and high-frequency attenuation are undesirable. Moreover, with the drive to miniaturize implantable electronic components (e.g., amplifiers, filters, etc.), adding protective mechanisms to defeat EMI is undesirable as these mechanisms would add bulk, cost, and weight to the implantable components.

The importance of restoring hearing to hearing-impaired persons demands more optimal solutions in hearing assistance systems. Ideally, an improved hearing assistance system both minimizes electromagnetic interference and maximizes high-frequency performance without adding unnecessary components to produce a better acoustic signal for reception into the inner ear.

SUMMARY OF THE INVENTION

An implantable hearing assistance system includes a sensor transducer and an electronics unit. The sensor transducer, such as a piezoelectric transducer, is operatively coupled to an auditory element of the middle ear (e.g., malleus), and is electrically connected to the electronics unit. The transducer and the electronics unit are arranged together to minimize the driving impedance and lead capacitance therebetween, thereby minimizing EMI susceptibility and minimizing high audio frequency signal attenuation of the hearing assistance system.

In one example, the transducer and the electronics unit are disposed immediately adjacent each other or physically joined together to virtually eliminate (or at least significantly shorten) the length of the electrical connection between the transducer and the electronics unit. This arrangement effectively prevents high frequency audio signal attenuation associated with lead capacitance of a long-length lead wire and/or associated with a high impedance sensor that drives the lead wire. Eliminating the electrical connection or lead wire minimizes EMI susceptibility since the conductor previously susceptible to EMI has been reduced to having little or no input impedance and little or no physical size. In another example, the electronics unit is located remotely from the transducer and a preamplifier (or other impedance transforming electronics) is placed in close physical proximity to the transducer in the middle ear between the transducer and the remaining electronics unit. This arrangement transforms the impedance from the high impedance sensor to the connecting lead wire so that a significantly smaller impedance is presented to the connecting lead wire. This impedance transformation reduces high frequency audio signal attenuation. Minimizing susceptibility to electromagnetic interference and minimizing high frequency audio signal attenuation with these methods and devices enhances hearing assistance achieved by middle ear implantable hearing assistance devices.

DETAILED DESCRIPTION OF THE PREFERRED EMBODIMENTS

Figure 1:
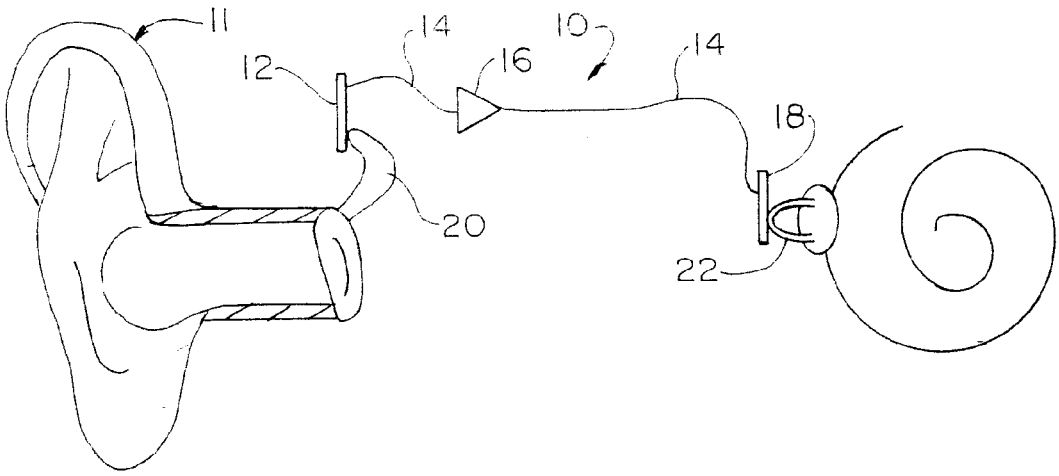
Fig. 1 PRIOR ART
FIG. 1 is a schematic diagram of a prior art implantable hearing assistance system.
Figure 2:
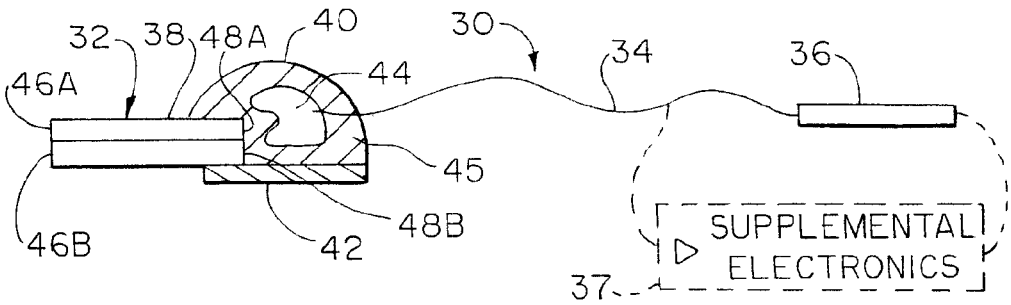
FIG. 2 is a schematic diagram of an implantable hearing assistance method and system of the present invention.

A hearing assistance system 30 of the present invention is shown in FIG. 2. As shown, system 30 includes sensor 32, lead wire 34, driver transducer 36 and supplemental electronics unit 37. Sensor 32 includes known piezoelectronic or electromagnetic bimorph transducer 38 and electronics module 40 mounted on an electrically conductive substrate 42, although other transducer structures are contemplated within the scope of this invention. Electronics module 40 includes electronic components such as amplifier 44 mounted within housing support 45 (e.g., potting or other formable housing material including plastic, etc.). Electronics unit 44 (or a portion thereof) and wires 48A, 48B also can be juxtaposed together so that wires 48A, 48B support electronics 44 with or without support 45, and/or electronics 44 and wires 48A, 48B are housed together in a single unit in which the wires house electronics 44 or electronics 44 house a portion of wires 48A, 48B. Bimorph transducer 38 includes known elements 46A and 46B, while lead wires 48A and 48B connect bimorph transducer 38 to electronics components 44 directly as shown, or through substrate 42 (see e.g., FIGS. 5 and 6). Sensor 32 with amplifier 44 is preferably directly electrically connected to driver transducer 36, although as shown in phantom, sensor 32 optionally can be electrically connected to supplemental electronics 37 and driver transducer 36. Supplemental electronics unit 37 includes accessory electronics for augmenting the electronic components 44 of sensor 32. Sensor 32 including bimorph transducer 38 and electronics module 40 are mounted within the middle ear proximate an auditory element of the ossicular chain, such as malleus 20 as shown for sensor 12 in FIG. 1.

In this embodiment, electronics module 40 is mechanically fastened directly to bimorph transducer 38. Electronics component 44 of module 40 includes signal amplification and filtering characteristics, while bimorph transducer 38 includes electrical-to-mechanical transducing characteristics. Of course, these amplification and electrical-to-mechanical transducing characteristics can be obtained in a different configuration of electronics and piezoelectric or electromagnetic components other than the configuration shown. Combining the high impedance bimorph transducer 38 and the high impedance electronics module 40 into a single unit eliminates the possibility of a long lead wire therebetween. This physical juxtaposition of electronics module 40 and bimorph transducer 38 dramatically reduces capacitance driven by the high impedance sensor (thereby maximizing high frequency audio performance) and reduces the length of lead wire picking up EMI (thereby minimizing EMI susceptibility).

For example, the high-frequency effect is inversely proportional to the lead wire length. If the lead wire is made 1/10th as long, the highest working frequency is increased by a factor of 10. For EMI susceptibility, a common rule of thumb is that the length of the lead wire should be kept to 1/20th of the wavelength of the impinging sounds. For 2 GHz signals, which are used in some radio equipment and proposed future telephones, this corresponds to a desired lead wire length of ¾ centimeters. Given these constraints, this rule of thumb is satisfied with the sensor and electronics mechanically fastened together, according to the present invention.

Figure 3:
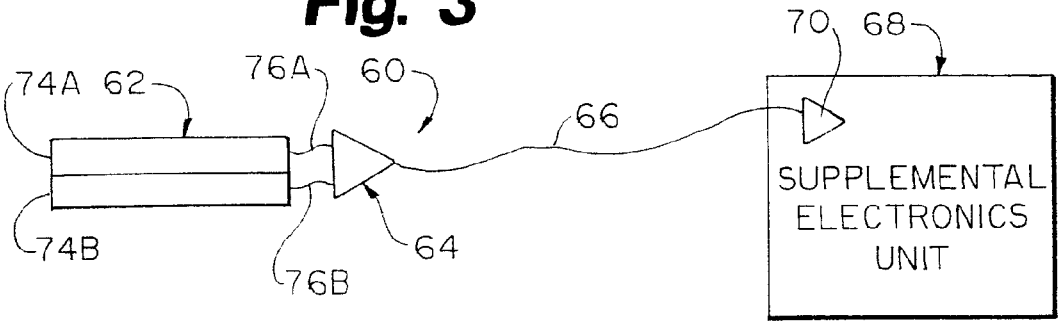
FIG. 3 is a schematic diagram of another embodiment of the implantable hearing assistance method and system of the present invention.

Another embodiment of the present invention includes hearing assistance system 60, shown in FIG. 3, including bimorph transducer 62, preamplifier 64, lead wire 66, and electronics unit 68 with amplifier 70. Bimorph transducer 62 includes elements 74A and 74B with lead wires 76A and 76B electrically connecting elements 74A and 74B of bimorph transducer 62 to preamplifier 64. Bimorph transducer 62 and preamplifier 64 are located within the middle ear, particularly with bimorph transducer 62 mechanically or operatively connected to an auditory element of the middle ear such as a stapes, malleus or incus. Preamplifier 64 is directly and mechanically connected to bimorph transducer 62, or located in close physical proximity thereto, on a mounting bracket or similar support. In one embodiment electronics unit 68 is located within, or adjacent to the middle ear, although certain embodiments may include remote location of this component. Locating high impedance preamplifier 64 in close physical proximity to high impedance bimorph transducer 62 permits electrically connecting lead wires 76A and 76B to be extremely short, thereby greatly diminishing the potential for electromagnetic interference and capacitance-based high audio frequency signal attenuation due to long length lead wires. Preamplifier 64 operates in conjunction with electronics unit 68 according to known signal processing principles.

In use, a mechanical acoustic sound energy signal is received at sensor 62, converted to an electrical signal by sensor 62, and amplified at preamplifier 64 prior to delivery of the electrical signal to electronics 68.

Of course, devices or combinations of components other than a preamplifier can act as an impedance transformation device to transform impedance between the high-input impedance sensor and an electrically-connecting lead wire.

Figure 4:
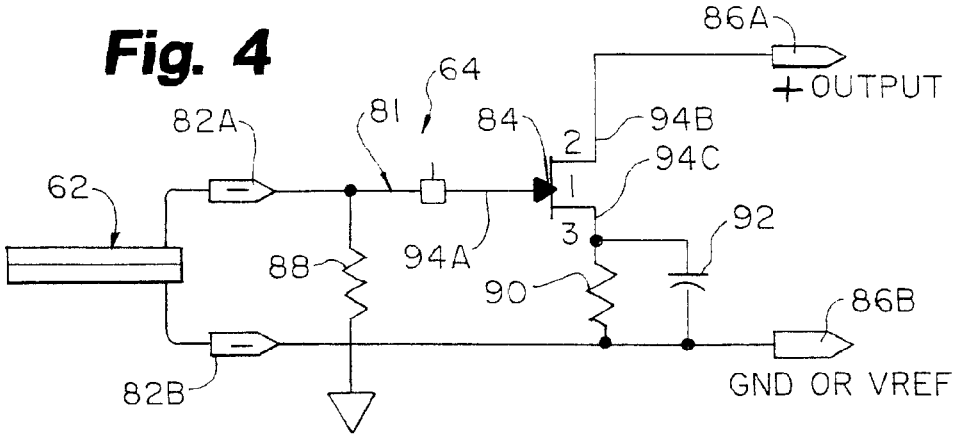
FIG. 4 is a schematic circuit diagram of an amplifier circuit of the method and system of the present invention.

FIG. 4 shows one example of implementing preamplifier 64 in conjunction with bimorph transducer 62 of FIG. 3. As shown in FIG. 4, preamplifier 64 includes JFET amplifier circuit 81, having inputs 82A and 82B from bimorph transducer 62 and outputs 86A, 86B. Circuit 81 further includes resistors 88 and 90, and capacitor 92. Resistors 88 and 90 preferably have impedances of about 4 Mohm and about 400 kohm respectively, while capacitor 92 has a capacitance of about 0.1 Micro F. JFET 84 has nodes 94A, 94B and 94C.

Node 94A is connected to input 82A from transducer 62 and to resistor 88 while node 94B defines circuit output 86A. Node 94C connects resistor 90 and capacitor 92 in parallel to JFET 84.

JFET amplifier circuit 81 advantageously provides both optimized impedance transformation, having an input impedance of 4 Mohm and an output impedance of merely 270 kohm, and optimal self-noise properties with some signal gain.

Figure 5:
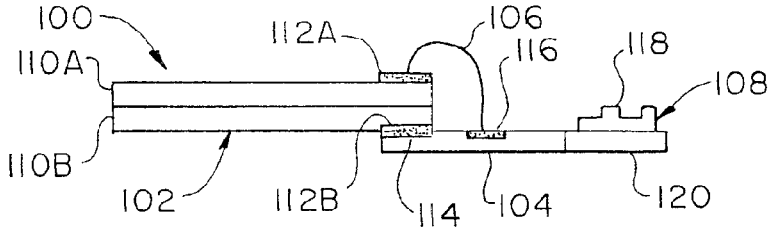
FIG. 5 is a plan side view of a transducer and amplifier combination of the present invention.

Another hearing assistance system 100 of the present invention is shown in FIG. 5 and can be used as a structural implementation of the embodiment shown in FIGS. 3 and 4. System 100 includes bimorph transducer 102, substrate 104, electrical connection lead wire 106 and preamplifier 108. Bimorph transducer 102 includes elements 110A and 110B, each having electrically conductive contact surface 112A and 112B. Substrate 104 is an electrically conductive member including electrically conductive contact surfaces 114 and 116 and is mechanically connected to preamplifier 108 having electronic circuitry and supporting member 120. Transducer 102 is electrically connected to preamplifier 108 in the following manner. Contact surface 112A of transducer element 110A is electrically connected to contact surface 116 of substrate 104 via electrical lead wire 106. However, element 110B of transducer 102 is electrically connected to substrate 104 via direct mechanical contact between contact surface 112B and 114.

Preamplifier 108 preferably has characteristics, features and attributes of the preamplifier 64 disclosed in FIGS. 3 and 4. However, other preamplifier configurations can be used. In addition, substrate 104 and supporting member 120 can be formed as part of or fastened to a mounting bracket, such as the bracket assembly shown later in FIG. 7.

This configuration virtually eliminates lead wire length between preamplifier 108 and transducer 102 since electrically conductive substrate 104 provides a partially direct electrical and mechanical connection therebetween with the use of only very short lead wire 106. This nearly complete direct electrical connection configuration greatly reduces the susceptibility of system 100 to electromagnetic interference and greatly reduces capacitance-based high-frequency audio signal attenuation.

Figure 6:
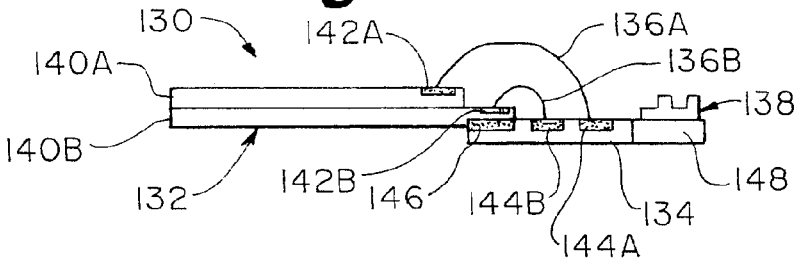
FIG. 6 is a plan side view of an alternative transducer and amplifier combination of the present invention.

Another hearing assistance system 130 of the present invention is shown in FIG. 6 and includes bimorph sensor transducer 132 (piezoelectric or electromagnetic), substrate 134, electrically connecting lead wires 136A and 136B and preamplifier 138. Sensor transducer 132 includes elements 140A and 140B and electrical contact surfaces 142A and 142B. Substrate 134 includes electrical contact surfaces 144A and 144B as well as mechanical connecting surface 146. Preamplifier 138 includes supporting member 148 which is mechanically and electrically connected to substrate 134.

The embodiment of FIG. 6 permits a pair of electrically connecting lead wires 136A and 136B to electrically connect transducer 132 to preamplifier 138 via electrically conductive substrate 134. While system 130 includes one additional lead wire more than the system shown in FIG. 5, the immediate, close physical proximity between preamplifier 138 and transducer 132 permits the use of extremely short electrical lead wires 136A and 136B which greatly diminishes the susceptibility of system 130 to electromagnetic interference and significantly reduces capacitance-based high-frequency audio signal attenuation. As shown in FIG. 6, bimorph transducer 132 includes a configuration in which elements 140A and 140B are staggered with element 140A being shorter than element 140B to permit exposure of electrical contact surfaces on the top surface of each of the respective elements 140A and 140B to permit electrical connection thereto.

Figure 7:
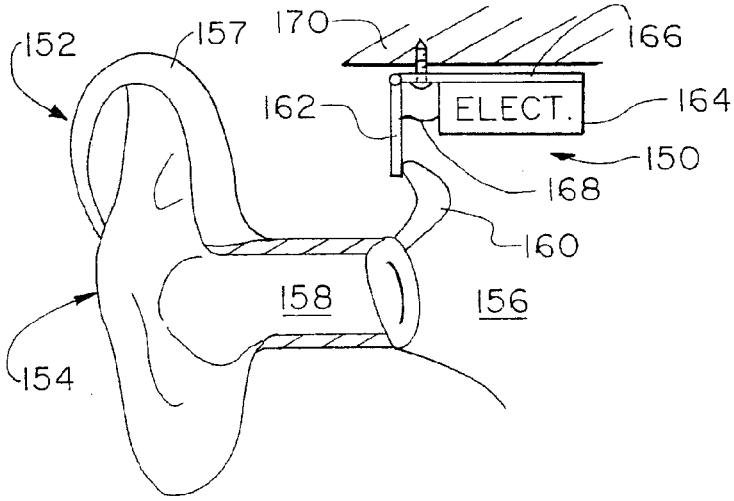
FIG. 7 is a plan view of an embodiment of the implantable hearing assistance method and system of the present invention incorporated into a human auditory system.

In use, transducer 132 is placed in contact with an auditory element such as malleus 20 as shown in FIG. 1 (or malleus 160 as shown in FIG. 7) for receiving mechanical sound vibrations therefrom wherein transducer 132 converts those sound vibrations into an electrical signal which is fed to preamplifier 138 via electrically connecting lead wires 136A, 136B and substrate 134. System 130 can be placed in operative contact with a malleus or other auditory element of the ossicular chain using suitable mounting means, such as a mounting bracket similar to mounting bracket assembly 166 shown in FIG. 7.

In another embodiment, hearing assistance system 150 of the present invention is shown in FIG. 7. As shown, human auditory system 150 includes outer ear 154 and middle ear 156. Pinna 157 forms outer ear 154 and joins with external auditory canal 158. Middle ear 156 includes malleus 160 separated from incus (not shown). System 150 includes sensor transducer 162, electronics/amplifier unit 164, bracket assembly 166, and connecting electrical lead wires 168. Mounting bracket 166 is fastened to mastoid bone 170 to secure sensor 162 in contact with malleus 160 and to support amplifier 164 in close physical proximity to transducer 162. Mounting electronics/amplifier unit 164 in close physical proximity to sensor transducer 162 permits a very short electrical connection 168 therebetween (or direct electrical connection with electrical contact elements between the amplifier 142 and transducer 146).

In use, acoustic sound energy is received by sensor 162 via malleus 160 and converted to an electrical sound signal. The electrical sound signal is carried along electrical lead wire 168 to amplifier/electronics 164 for amplification and further signal processing steps prior to further transmission to driver transducer coupled to a stapes (not shown). Arranging high impedance amplifier/electronics 164 in close physical proximity to high impedance transducer 162 dramatically reduces susceptibility to electromagnetic interference.

Although the present invention has been described with reference to preferred embodiments, workers skilled in the art will recognize that changes may be made in form and detail without departing from the spirit or scope of the present invention.

What is claimed is:

1. An implantable hearing assistance system capable of maximizing high frequency audio performance and minimizing electromagnetic interference and high frequency audio attenuation, comprising:

a high impedance sensor transducer;

an impedance transformation device located at a minimal distance from and electrically connected to the sensor transducer, the minimal distance designed to eliminate the possibility of having a greater length of electrical connection between the sensor transducer and the impedance transformation device that is susceptible to electromagnetic interference and high frequency audio attenuation;

a high impedance electronics unit electrically connected to the impedance transformation device; and a driver transducer electrically connected to the electronics unit.

2. The system of claim 1, wherein the sensor transducer is a piezoelectric transducer.

3. The system of claim 1, wherein the sensor transducer is an electromagnetic transducer.

4. The system of claim 1, wherein the impedance transformation device is located at a maximum distance from the sensor transducer equal to ½ of the total distance between the sensor transducer and the electronics unit.

5. The system of claim 1, wherein the sensor transducer and the electronics unit are electrically connected with at least one lead wire of a minimal length, the minimal length designed to eliminate the possibility of having a greater length of electrical connection between the sensor transducer and the impedance transformation device that is susceptible to electromagnetic interference and high frequency audio attenuation.

6. The system of claim 5, wherein the minimal length of the lead wire is a maximum of $1/20^{th}$ as long as the wavelength of the interfering signals impinging on the hearing assistance system.

7. The system of claim 5, wherein the minimal length of the lead wire is a maximum of ¾ centimeter for a 2 GHz input signal.

8. The system of claim 1, further comprising two lead wires electrically connecting the electronics unit to the impedance transformation device wherein the wires are adapted to provide a matched pair of differential input to the impedance transformation device.

9. The system of claim 1, further including an electrically conductive substrate configured for electrically connecting the impedance transformation device to the sensor transducer.

10. The system of claim 1, wherein the impedance transformation device is disposed adjacent to the sensor transducer.

11. The system of claim 1, wherein the impedance transformation device is physically connected to the sensor transducer.

12. The system of claim 1, wherein the impedance transformation device and the sensor transducer are housed as a single unit.

13. The system of claim 1, further comprising a support member for supporting the sensor transducer and impedance transformation device.

14. The system of claim 13, wherein the support member supports the impedance transformation device and at least an adjacent portion of the sensor transducer.

15. The system of claim 13, wherein the support member further includes an electrically conductive substrate electrically connecting the sensor transducer to the impedance transformation device.

16. The system of claim 1, wherein the impedance transformation device is a preamplifier.

17. The system of claim 1, wherein the impedance transformation device includes a JFET amplifier circuit.

18. An implantable hearing assistance system capable of maximizing high frequency audio performance and minimizing electromagnetic interference and high frequency audio attenuation, comprising:

a high impedance sensor transducer;

a high impedance electronics unit disposed at a minimal distance from and electrically connected to the sensor transducer, the minimal distance designed to eliminate the possibility of having a greater length of electrical connection between the sensor transducer and the high impedance electronics unit that is susceptible to electromagnetic interference and high frequency audio attenuation.

19. The system of claim 18, further comprising a driver transducer electrically connected to the electronics unit.

20. The system of claim 18, wherein the sensor transducer is a piezoelectric transducer.

21. The system of claim 18, wherein the sensor transducer is an electromagnetic transducer.

22. The system of claim 18, wherein the minimal distance is a maximum of $1/20^{th}$ of the wavelength of interfering signals impinging upon the hearing assistance system.

23. The system of claim 18, wherein the minimal distance is a maximum of ½ centimeter for a 2 GHz input signal.

24. The system of claim 18, wherein the electronics unit is electrically connected directly to the sensor transducer through an electrically conductive substrate.

25. The system of claim 18, wherein the electronics unit is mechanically connected to the sensor transducer through a bracket adapted to support both the electronics unit and the sensor transducer, the bracket also adapted to be mounted to an auditory element of the middle ear.

26. The system of claim 18, wherein the electronics unit includes an amplifier.

27. The system of claim 18, wherein the electronics unit and sensor transducer are housed as a single unit.

28. The system of claim 18, further including a housing support for housing the electronics unit and at least an adjacent portion of the sensor transducer.

29. The system of claim 18, further comprising a support member for supporting the sensor transducer and impedance transformation device.

30. The system of claim 29, wherein the support member supports the impedance transformation device and at least an adjacent portion of the sensor transducer.

31. The system of claim 29, wherein the support member further includes an electrically conductive substrate electrically connecting the sensor transducer to the impedance transformation device.

32. An implantable hearing assistance system capable of maximizing high frequency audio performance and minimizing electromagnetic interference and high frequency audio attenuation, comprising:

an electronics unit housing one or more electronic components; and a sensor transducer mechanically connected to the electronics unit and electrically connected to the electronic components by two or fewer lead wires having a minimal length and configured for eliminating the need to use a longer lead wire that is more susceptible to electromagnetic interference and high frequency audio attenuation.

33. The system of claim 32, wherein the sensor transducer is a piezoelectric transducer.

34. The system of claim 32, wherein the sensor transducer is an electromagnetic transducer.

35. The system of claim 32, further comprising a driver transducer electrically connected to the electronics module.

36. The system of claim 32, wherein one of the electronic components includes an amplifier.

37. The system of claim 32, wherein the electronics unit is electrically connected directly to the sensor transducer through electrically conductive substrate.

38. The system of claim 32, further including a mounting component adapted to mount the electronics unit and the sensor transducer at a minimal distance from each other, the minimal distance designed to eliminate the possibility of having a greater length of electrical connection between the sensor transducer and the electronics unit that is susceptible to electromagnetic interference and high frequency audio attenuation.

39. The system of claim 38, wherein the mounting component comprises a bracket adapted to support the electronics unit and the sensor transducer and be mounted to an auditory element of the middle ear.

40. The system of claim 32, wherein the electronics unit and sensor transducer are housed as a single unit.

41. The system of claim 32, further comprising a support member for supporting the sensor transducer and the electronics unit.

42. The system of claim 41, wherein the support member supports the electronics unit and at least an adjacent portion of the sensor transducer.

43. The system of claim 41, wherein the support member further includes an electrically conductive substrate electrically connecting the sensor transducer to the electronics unit.

44. A mounting support for an implantable hearing system device for mounting components of the hearing system at a minimal distance from each other, thereby minimizing electromagnetic interference and high frequency audio attenuation, the mounting support comprising:

a bracket adapted to support a transducer and one or more auditory components of the implantable hearing assistance system directly adjacent from each other and be mounted to an auditory element of the middle ear.

45. The mounting support of claim 44, wherein the one or more auditory components include an impedance transformation device.

46. The mounting support of claim 44, wherein the one or more auditory components include an electronics unit.

47. The mounting support of claim 44, wherein the transducer is separated from the one or more auditory components at a minimal distance, the minimal distance being a maximum of $1/20^{th}$ as long as the wavelength of the interfering signals impinging on the hearing assistance system.

48. The mounting support of claim 44, wherein the transducer is separated from the one or more auditory components at a minimal distance, the minimal distance being a maximum of ¾ centimeter for a 2 GHz input signal.

49. A method of positioning an implantable hearing assistance system inside of an ear so as to maximize high frequency audio performance and minimize electromagnetic interference and high frequency audio attenuation, comprising the steps of:

positioning a high impedance sensor transducer in contact with an auditory element of the middle ear;

positioning an impedance transformation device at a minimal distance from the sensor transducer, the minimal distance designed to eliminate the possibility of having a greater length of electrical connection between the sensor transducer and the impedance transformation device that is susceptible to electromagnetic interference and high frequency audio attenuation providing a short length of electrical connection between the sensor transducer and the impedance transformation device.

50. The method of claim 49, wherein the step of positioning an impedance transformation device at a minimal distance from the sensor transducer includes the step of physically connecting the impedance transformation device to the sensor transducer.

51. The method of claim 49, wherein the step of positioning an impedance transformation device at a minimal distance from the sensor transducer is accomplished by housing the impedance transformation device and the sensor transducer in one unit.

52. The method of claim 49 wherein the step of positioning an impedance transformation device at a minimal distance from the sensor transducer includes the step of positioning the impedance transformation device adjacent to the sensor transducer.

53. The method of claim 49, wherein the step of positioning an impedance transformation device at a minimal distance from the sensor transducer includes the steps of mounting both the impedance transformation device and the sensor transducer on a single bracket assembly and mounting the bracket assembly to a bone.

54. The method of claim 53, wherein the bone is the mastoid bone.

55. The method of claim 49, wherein the minimal distance between the sensor transducer and the impedance transformation device is a maximum of $1/20^{th}$ as long as a wavelength of an interfering signal impinging on the components of the hearing system.

56. The method of claim 49, wherein the minimal distance between the sensor transducer and the impedance transformation device is a maximum of ¾ centimeter for a 2 GHz input signal.

57. The method of claim 49, wherein the step of providing a short length of electrical connection between the sensor transducer and the impedance transformation device includes using two or fewer lead wires having a minimal length and configured for eliminating the need to use a longer lead wire that is more susceptible to electromagnetic interference and high frequency audio attenuation.

58. The method of claim 49, wherein the step of providing a short length of electrical connection between the sensor transducer and the impedance transformation device is accomplished by connecting an electrically conductive substrate to electrically conductive surfaces of the sensor transducer and impedance transformation device.

59. The method of claim 49, wherein the impedance transformation device is a preamplifier.

60. The method of claim 49, further including the step of electrically connecting an electronics unit to the impedance transformation device.

61. The method of claim 60, further including the step of electrically connecting a driver transducer to the electronics unit.

62. A method of positioning an implantable hearing assistance system inside of an ear so as to maximize high frequency audio performance and minimize electromagnetic interference and high frequency audio attenuation, comprising the steps of:

positioning a high impedance sensor transducer in contact with an auditory element of the middle ear;

positioning a high impedance electronics unit at a minimal distance from the sensor transducer, the minimal distance designed to eliminate the possibility of having a greater length of electrical connection between the sensor transducer and the impedance transformation device that is susceptible to electromagnetic interference and high frequency audio attenuation; and providing a short length of electrical connection between the sensor transducer and the electronics unit.

63. The method of claim 62, wherein the step of positioning an electronics unit at a minimal distance from the sensor transducer includes physically connecting the electronics unit to the sensor transducer.

64. The method of claim 62, wherein the step of positioning an electronics unit at a minimal distance from the sensor transducer includes housing the electronics unit and the sensor transducer into one unit.

65. The method of claim 62, wherein the step of positioning an electronics unit at a minimal distance from the sensor transducer includes positioning the electronics unit adjacent to the sensor transducer.

66. The method of claim 62, wherein the step of positioning an electronics unit at a minimal distance from the sensor transducer includes mounting both the electronics unit and the sensor transducer on a single bracket assembly and mounting the bracket assembly to a bone.

67. The method of claim 66, wherein the bone is the mastoid bone.

68. The method of claim 62, wherein the minimal distance between the sensor transducer and the electronics unit is a maximum of $1/20^{th}$ as long as a wavelength of an interfering signal impinging on the sensor transducer and other components of the hearing system.

69. The method of claim 62, wherein the minimal distance between the sensor transducer and the electronics unit is a maximum of ¾ centimeter for a 2 GHz input signal.

70. The method of claim 62, wherein the step of providing a short length of electrical connection between the sensor transducer and the electronics unit includes using two or fewer lead wires having a minimal length and configured for eliminating the need to use a longer lead wire that is more susceptible to electromagnetic interference and high frequency audio attenuation.

71. The method of claim 62, wherein the step of providing a short length of electrical connection between the sensor transducer and the electronics unit includes connecting an electrically conductive substrate to electrically connect the sensor transducer to the electronics unit.

72. The method of claim 62, wherein the electronics unit further includes an amplifier.

73. The method of claim 62, further including the step of electrically connecting an driver transducer to the electronics unit.

74. A method of positioning an implantable hearing assistance system inside of an ear so as to maximize high frequency audio performance and minimize electromagnetic interference and high frequency audio attenuation, comprising the steps of:

mounting a high impedance sensor transducer on a bracket;

mounting one or more components of the hearing system on the bracket at a minimal distance from the sensor transducer, the minimal distance designed to eliminate the possibility of having a greater length of electrical connection between the sensor transducer and the one or more components of the hearing system that is susceptible to electromagnetic interference and high frequency audio attenuation;

mounting the bracket to an auditory element of the middle ear; and electrically connecting the sensor transducer to the one or more components of the hearing system so that the length in electrical connection is minimal.

75. The method of claim 74, wherein the one or more components of the hearing system include an impedance transformation device.

76. The method of claim 75, wherein the impedance transformation device is a preamplifier.

77. The method of claim 74, wherein the one or more components of the hearing system include an electronics unit.

78. The method of claim 77, wherein the electronics unit further includes an amplifier.

79. The method of claim 74, wherein the minimal distance is a maximum of $1/20^{th}$ as long as a wavelength of interfering signals impinging on the sensor transducer and other components of the hearing system.

80. The method of claim 74, wherein the minimal distance is a maximum of ¾ centimeter for a 2 GHz input signal.

81. The method of claim 74, wherein the step of electrically connecting the sensor transducer to one or more components of the hearing system includes using one or more lead wires having a minimal length and configured for eliminating the need to use a longer lead wire that is more susceptible to electromagnetic interference and high frequency audio attenuation.

82. The method of claim 81, wherein the one or more minimal length lead wires has a maximum length of ¾ centimeter for a 2 GHz signal.

83. The method of claim 81, wherein the one or more minimal length lead wires has a maximum length of $1/20^{th}$ as long as a wavelength of an interfering signal impinging on the sensor transducer and other components of the hearing system.

* * * * *